US007083357B2

(12) United States Patent
Lamore

(10) Patent No.: US 7,083,357 B2
(45) Date of Patent: Aug. 1, 2006

(54) RETRACTABLE WIDE-SPAN VEHICLE BARRIER SYSTEM

(76) Inventor: Michael J. Lamore, 818 Northern Shores Point, Greensboro, NC (US) 27455

( * ) Notice: Subject to any disclaimer, the term of this patent is extended or adjusted under 35 U.S.C. 154(b) by 0 days.

(21) Appl. No.: 11/065,494

(22) Filed: Feb. 24, 2005

(65) Prior Publication Data

US 2006/0140717 A1 Jun. 29, 2006

Related U.S. Application Data

(60) Provisional application No. 60/639,935, filed on Dec. 29, 2004.

(51) Int. Cl.
*E01F 15/00* (2006.01)

(52) U.S. Cl. ..... 404/6

(58) Field of Classification Search ..... 404/6, 404/10; 244/110 C; 256/13.1
See application file for complete search history.

(56) References Cited

U.S. PATENT DOCUMENTS 3,013,750 A 12/1961 Fondén et al.
3,307,833 A * 3/1967 Muller et al. ..... 256/13.1
3,367,608 A 2/1968 Charno et al.
3,484,061 A * 12/1969 Niemkiewicz ..... 244/110 R
3,622,107 A 11/1971 Bernard
3,738,599 A 6/1973 Borehag
3,827,660 A 8/1974 Doolittle
3,876,170 A 4/1975 Whittingham
3,938,763 A * 2/1976 DiGiovanniantonio .. 244/110 C
4,056,247 A 11/1977 Bernard et al.
4,147,317 A 4/1979 Mayhew et al.
4,630,395 A 12/1986 Nasatka
4,824,282 A * 4/1989 Waldecker ..... 404/6
4,979,701 A 12/1990 Colarik et al.
5,592,149 A * 1/1997 Alizi ..... 340/550
5,624,203 A * 4/1997 Jackson et al. ..... 404/6
5,762,443 A 6/1998 Gelfand et al.
5,823,705 A 10/1998 Jackson et al.
5,829,912 A * 11/1998 Marcotullio et al. ..... 404/6

(Continued)

FOREIGN PATENT DOCUMENTS

WO 92/02688 * 2/1992

OTHER PUBLICATIONS

Universal Safety Response, Inc.; GRAB (Ground Retractable Automobile Barrier): The New Standard in Barrier Systems; http://www.usrgrab.com; Feb. 23, 2005.

(Continued)

*Primary Examiner*—Gary S. Hartmann
(74) *Attorney, Agent, or Firm*—Alston & Bird LLP

(57) ABSTRACT

A vehicle barrier system that stops unwanted vehicle intrusion, controls vehicle access, and protects assets and critical infrastructure. The vehicle barrier system, which can span up to 250 feet without requiring fixed intermediate supports, will stop a 15,000 lb vehicle traveling at impact speed of 50 mph. The barrier net is attached to vertical steel end supports anchored in concrete, and include energy absorbers, pivoting connections, and force equalization bars. The barrier net can remain in the "up" or "down" position, and can be raised or lowered using a winch powered by common 12 volt battery with solar power recharge. The barrier net and system components are modular, and can be easily installed or removed.

14 Claims, 8 Drawing Sheets

U.S. PATENT DOCUMENTS

| | | | | |
|---|---|---|---|---|
| 5,961,099 | A | 10/1999 | Thommen, Jr. | |
| 5,993,104 | A * | 11/1999 | Marcotullio et al. | 404/6 |
| 6,186,274 | B1 | 2/2001 | Reynolds et al. | |
| 6,312,188 | B1 * | 11/2001 | Ousterhout et al. | 404/6 |
| 6,322,285 | B1 | 11/2001 | Ben | |
| 6,409,420 | B1 | 6/2002 | Horton et al. | |
| 6,485,225 | B1 * | 11/2002 | Baker | 404/6 |
| 6,581,875 | B1 | 6/2003 | Colarik | |
| 6,843,613 | B1 | 1/2005 | Gelfand et al. | |

OTHER PUBLICATIONS

Miscellaneous Information on GRAB-sp Barrier System (5 pgs.).

Israel building underwater wall, World Tribune.com, Feb. 3, 2006, 1 pg.

Gnessin, Alex, Israel to Build Undersea Barrier to Ward Off Attacks, The Epoch Times, Jun. 21, 2005, 1 pg.

* cited by examiner

RETRACTABLE WIDE-SPAN VEHICLE BARRIER SYSTEM

CROSS REFERENCE TO RELATED APPLICATION

The present application claims priority pursuant to 35 U.S.C. 119(e) to U.S. Provisional Application Ser. No. 60/639,935, filed Dec. 29, 2004.

BACKGROUND OF THE INVENTION

1. Field of the Invention

The present invention is related to vehicle barrier systems, and more particularly to net-based vehicle barrier systems that span a long distance that can be readily raised or lowered and that can be easily deployed.

2. Description of Related Art

Originally, net-based barrier systems with energy absorption devices at end supports were associated with aircraft arresting devices. These systems are designed so that the aircraft arresting net system is let out more than 100 feet upon impact and the aircraft slowly decelerates to a stop over a long distance, to minimize damage to the aircraft. Such systems are not directly applicable to vehicle barrier systems because the net system, energy absorption units, and end supports of vehicle barrier systems are designed to completely stop vehicle over a short distance regardless of the amount of damage caused to the vehicle.

Vehicle barrier systems rated to stop a 15,000 lb vehicle at impact speed of 50 mph of the prior art include large sliding steel gates, steel bollards filled with concrete and anchored into footings, interlocking concrete surface barriers, horizontal steel bars with end supports, pop up steel plates, steel cable systems at short spans with fixed end supports, and other related barrier systems of the prior art. These barrier systems are limited by the length of area that can be secured without adding fixed supports that penetrate the subsurface, and this limitation is typically 15 to 60 feet. In addition, these barrier systems require an electrical power supply, require backup power systems, and use hydraulics or pistons, resulting in maintenance, repairs, and downtime of the barrier. Many of these systems are not an "all weather" use. These barrier systems are either semi-fixed in-place and are not easily removed, or permanently fixed in-place and, therefore, permanently block off vehicle access to the secured area. Onsite installation of prior art systems can take several weeks. System components are neither modular nor disconnected easily. Barriers made of steel and concrete create additional projectiles upon an impact event, and require significant repair work in the aftermath to restore a barrier to operational status.

BRIEF SUMMARY OF THE INVENTION

The invention addresses the above needs and achieves other advantages by providing a barrier system that is modular and easily deployed. Preferably the barrier system is capable of stopping a 15,000 lb vehicle at impact speed exceeding 50 mph, which can free span up to 250 feet without need for intermediate fixed supports. An objective of this invention is to provide capability to raise or lower barrier net system in less than 60 seconds, to allow a vehicle to drive over a lowered net without causing damage to the system, and to completely disconnect and remove the barrier system in less than 10 minutes so that vehicle access to the secured area is restored. Another objective of this invention is to allow for steel sleeves embedded in concrete, so that vertical steel supports can be slid in or slid out. Another objective of this invention is to eliminate requirement for an external power or fuel source making this barrier system self-sufficient and able to operate in remote locations. Another objective of this vehicle barrier system is to provide wireless control to raise or lower barrier net from a remote location, such as with a satellite phone or the like. Another objective of this invention is to make system components modular, meet military shipping requirements regarding size and weight, with ability to package and ship barrier system anywhere. Another objective of this invention is to provide end supports, energy absorption systems, components, and connections that are reusable, without requiring extensive repair after a major impact event. Another objective of this invention is to be able to disconnect system components without causing destruction. Another objective of this invention is to provide alarm capability to signal a vehicle impact event. Another objective of this invention is to provide components that are "all weather" use. Another objective of this barrier system is to have visibility through the barrier, allowing one to see an oncoming vehicle. Another objective of this vehicle barrier system is to not cause loss of life upon major vehicle impact event, allowing for interrogation of driver. Another objective of this invention is to prevent total vehicle destruction upon impact, allowing preservation of evidence. As such, the barrier system of the present invention provides protection against possible terrorist activities, particularly truck-loaded bombs in remote locations.

BRIEF DESCRIPTION OF THE SEVERAL VIEWS OF THE DRAWINGS

Figure 1:
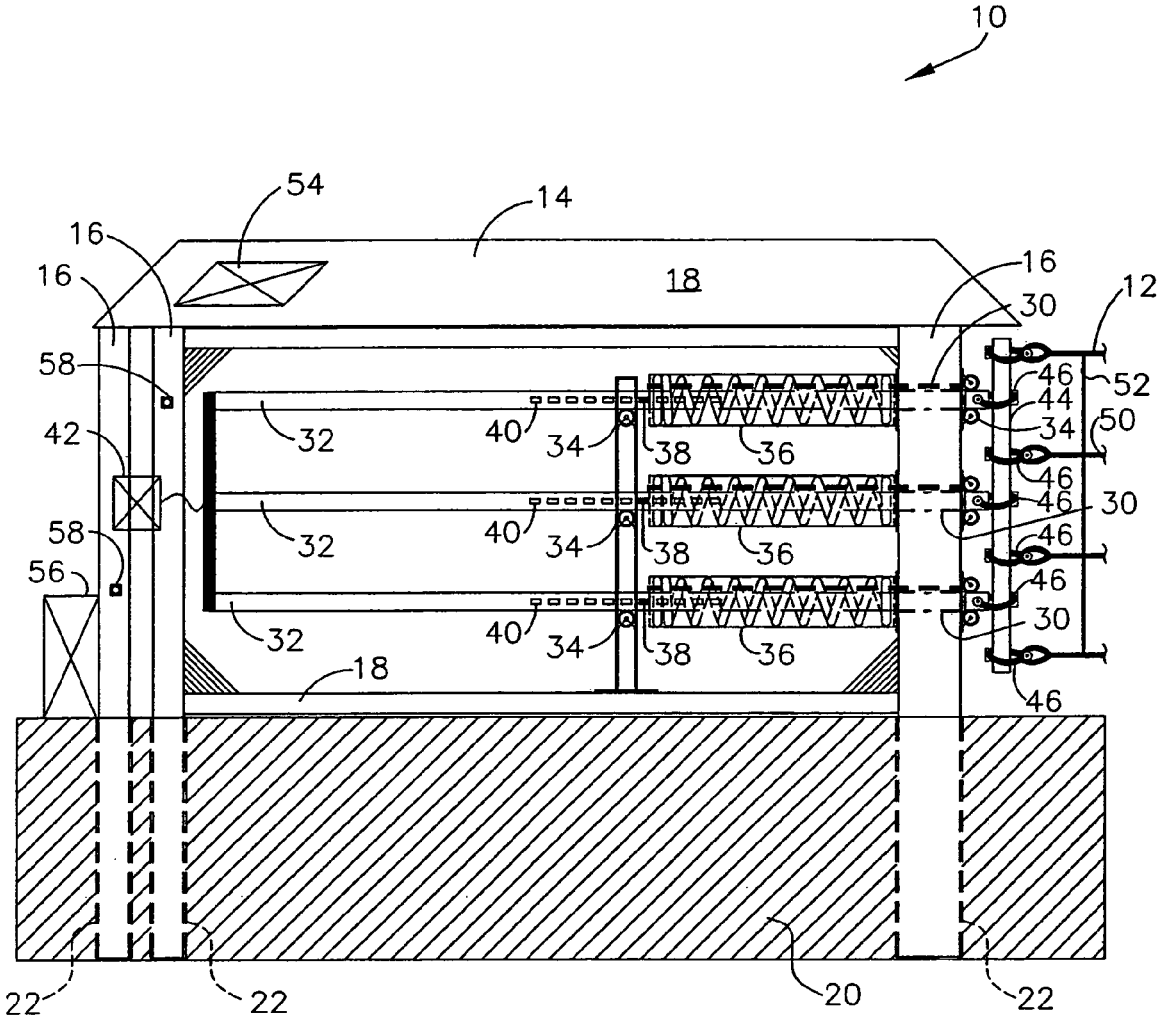
Figure 2:
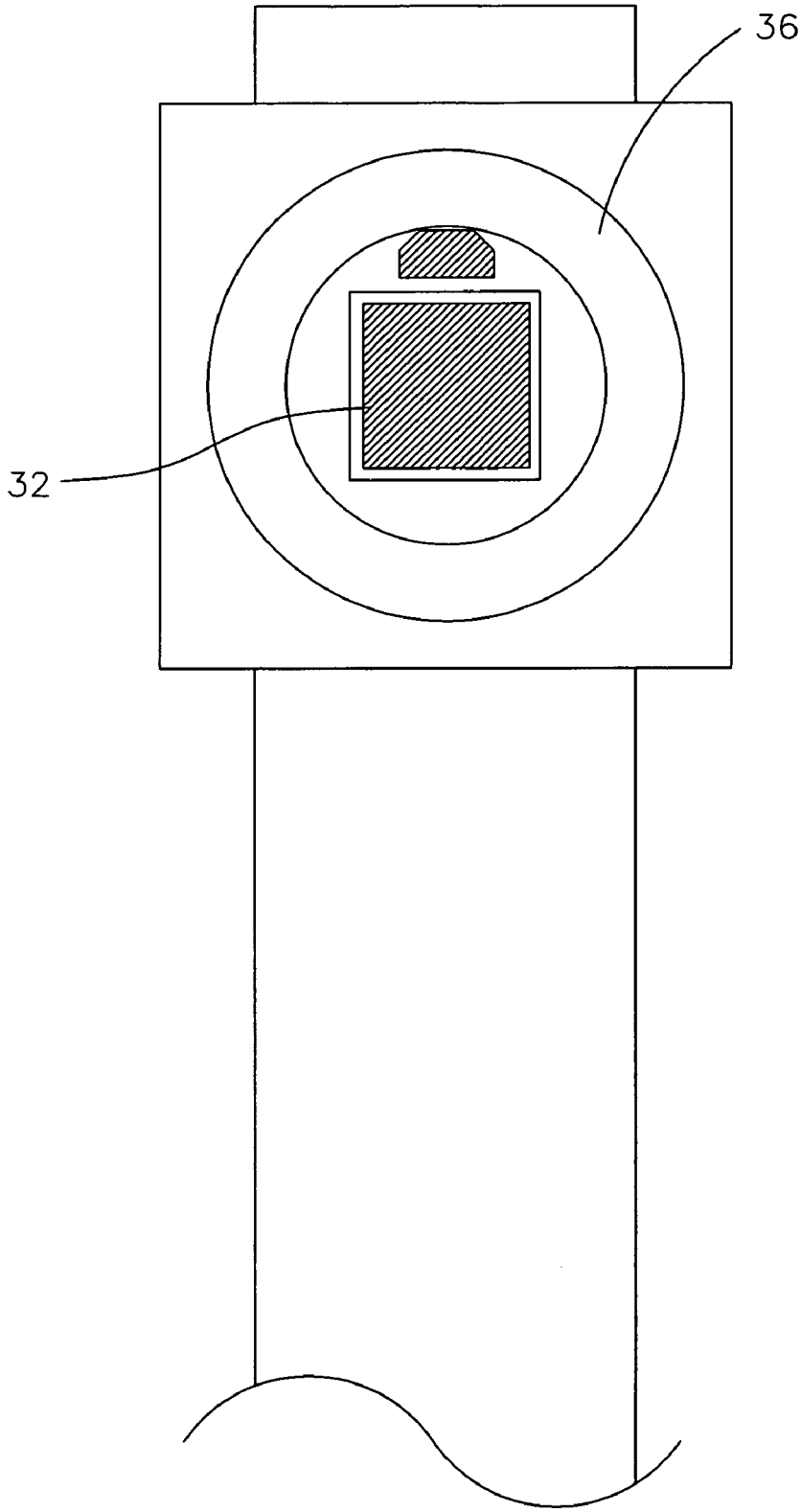
Figure 3:
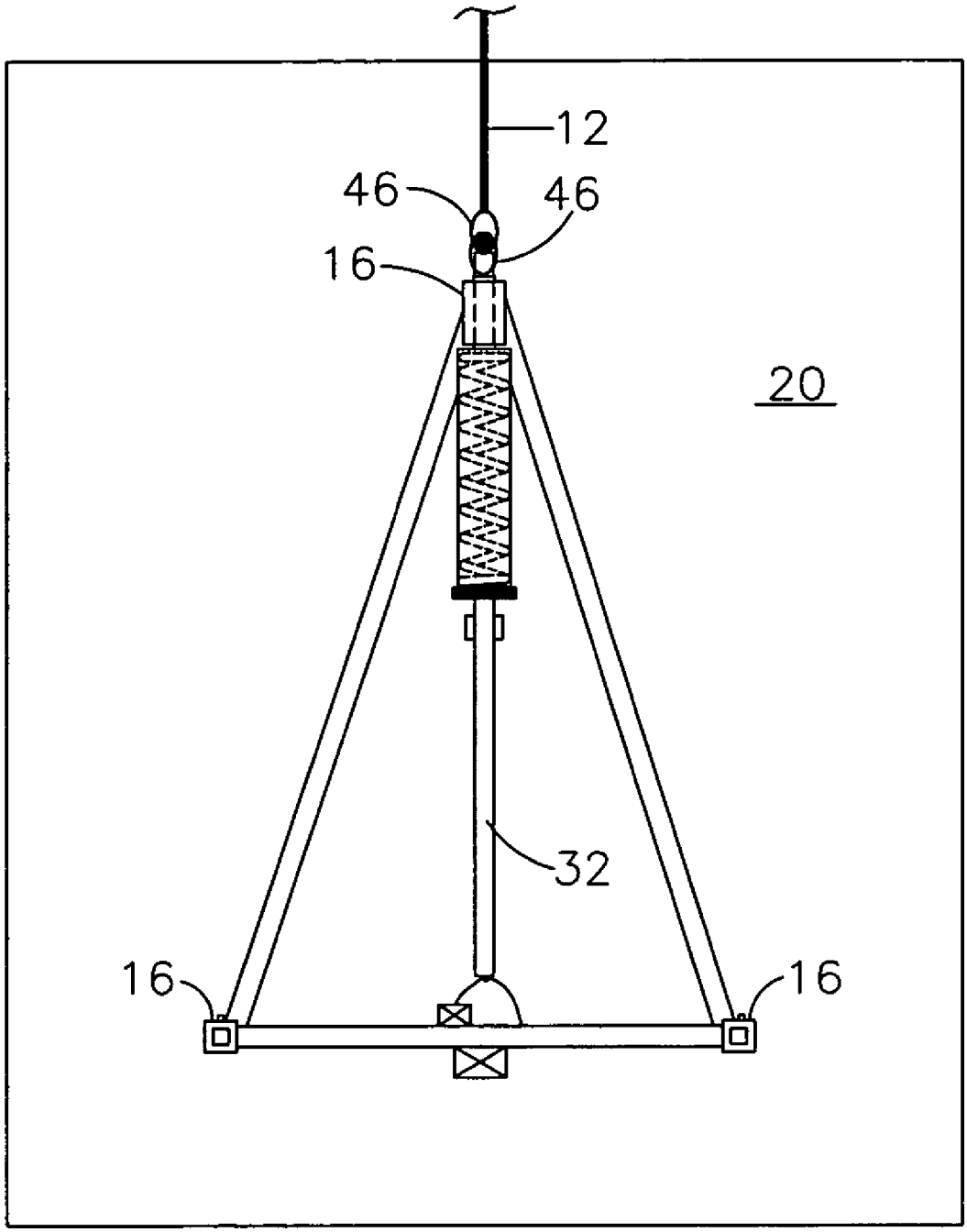
Figure 4:
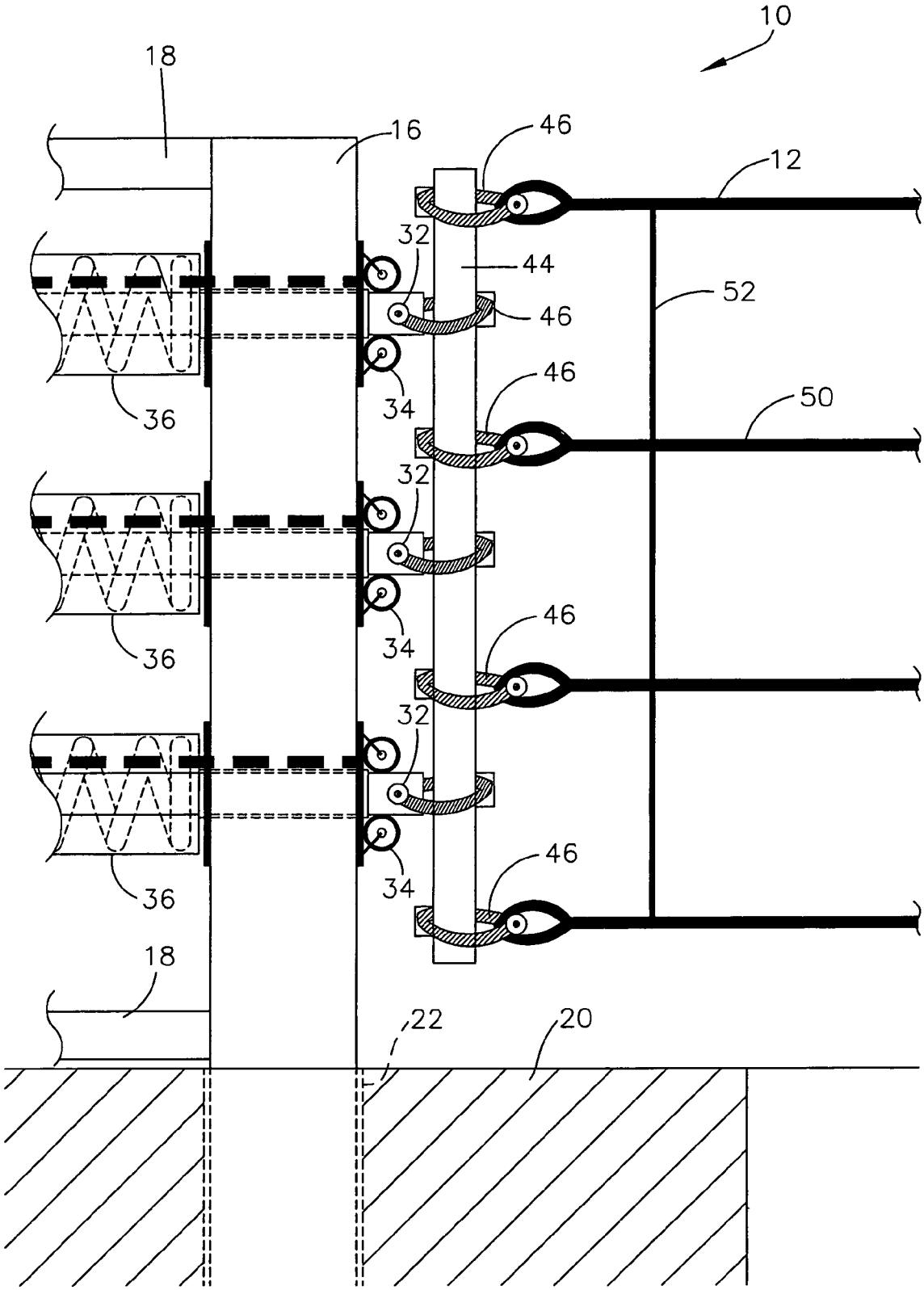
Figure 5:
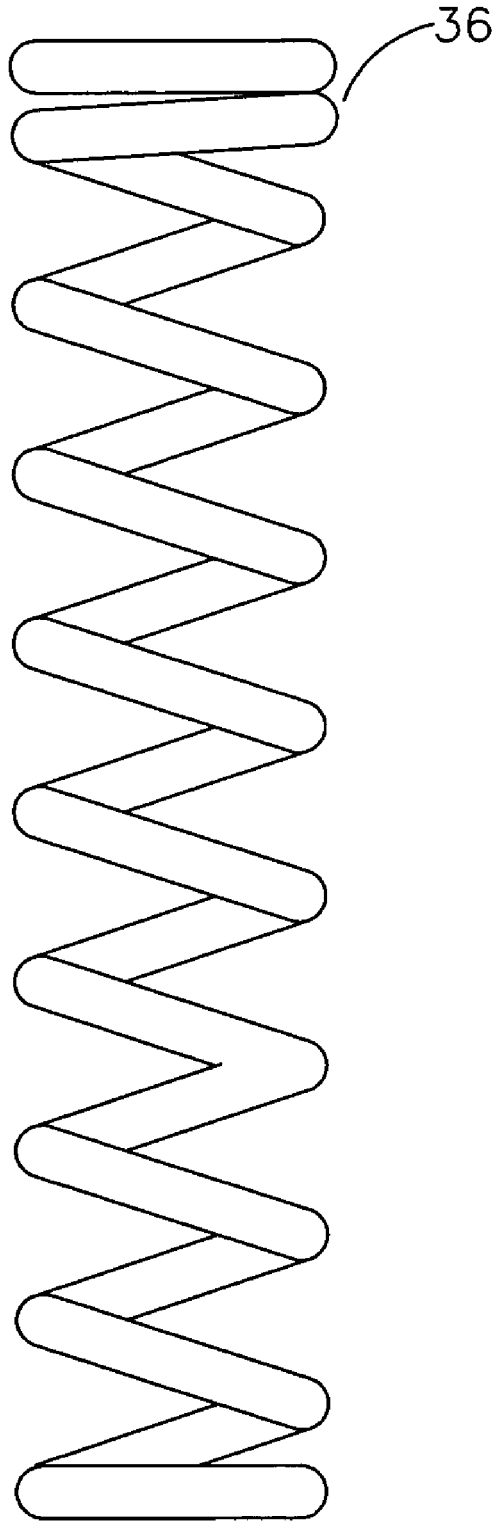
Figure 6:
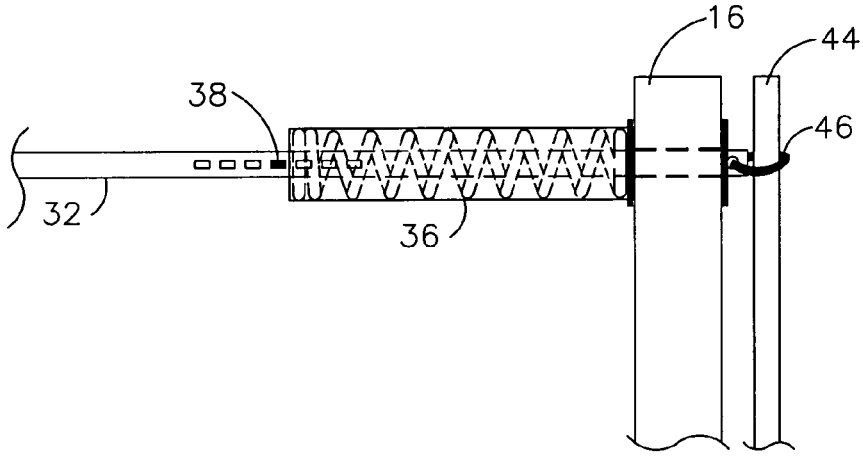
Figure 7:
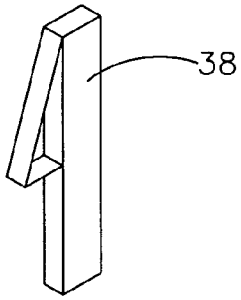
Figure 8:
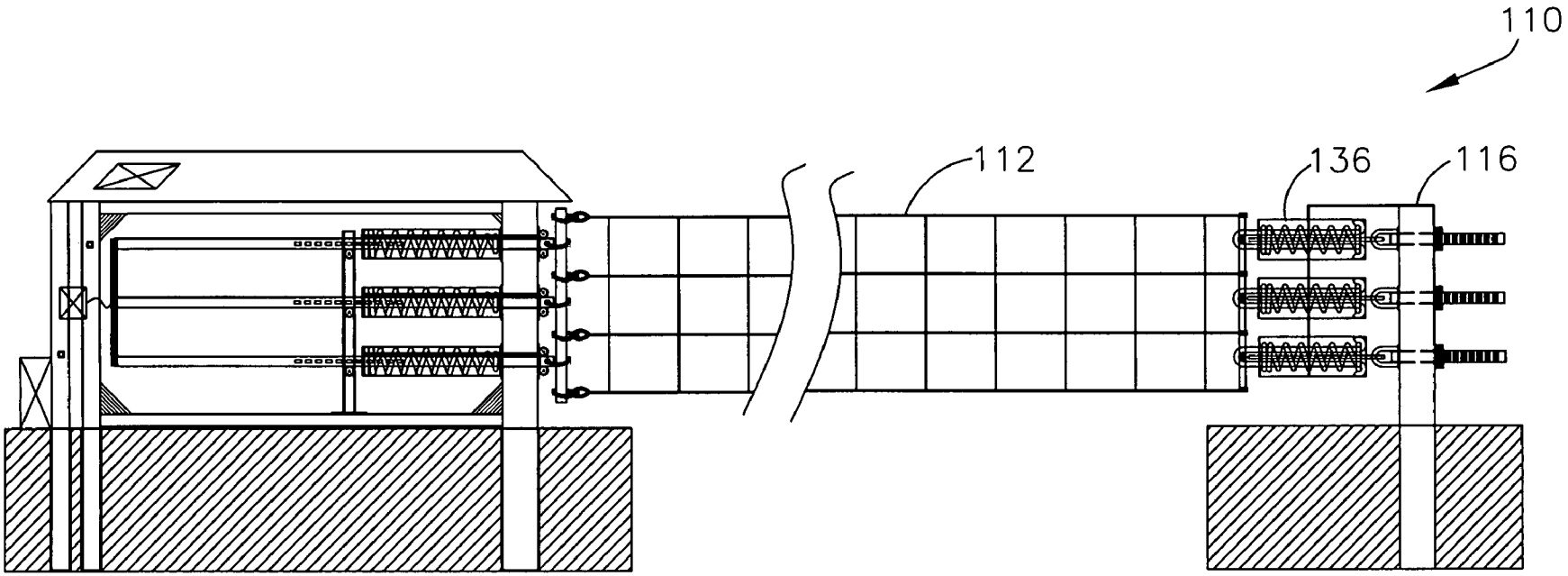
Figure 9:
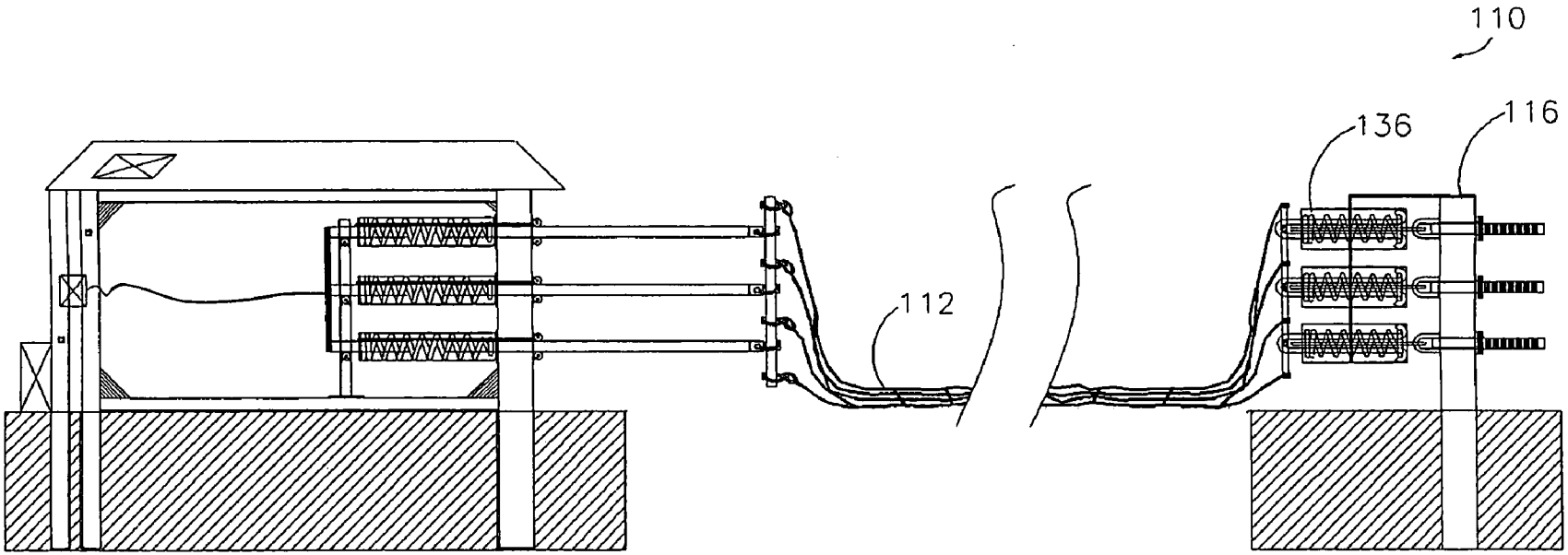

Having thus described the invention in general terms, reference will now be made to the accompanying drawings, which are not necessarily drawn to scale, and wherein:

FIG. 1 is a side elevational view of one embodiment of the barrier system, illustrating an end support and a net system;

FIG. 2 is a cross-sectional view of an energy absorber of the barrier system of FIG. 1;

FIG. 3 is a top elevational view of the barrier system of FIG. 1;

FIG. 4 is a side elevational view of the barrier system of FIG. 1, illustrating a stanchion and net system;

FIG. 5 is a side elevational view of an energy absorber of the barrier system of FIG. 1;

FIG. 6 is a side elevational view of a sliding adjustment bar of the barrier system of FIG. 1;

FIG. 7 is a perspective view of a pin of the barrier system of FIG. 1;

FIG. 8 is a side elevational view of a second embodiment of the barrier system, illustrating the energy absorbers on the inside of the vertical tubes; and FIG. 9 is a side elevational view of the barrier system of FIG. 8, illustrating the net system in the lowered position.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements.

With reference to FIGS. 1–6, a barrier system 10 in accordance with one embodiment of the present invention is illustrated. The barrier system 10 includes a net system 12 that is supported on each of two ends by an end support 14. Each end support 14 preferably includes three (3) vertical steel tubes 16 arranged in a triangular pattern, with the 8"×12" larger steel tube in front and the two (2) smaller 6"×6" steel tubes at the rear. Each of the three (3) vertical steel tubes 16 are connected together for structural support using a 4"×4" horizontal steel member 18 attached at both the top and bottom of each vertical tube. This triangular shaped pattern for vertical supports, combined with the horizontal steel member connections, provide the necessary end support strength against pullout, moment, shear, twist, and torque. Alternative embodiments of the present invention may include only two (2) steel tubes, or even only one (1) steel tube, depending upon the specific application requirements. Further embodiments of the present invention may include any size, number, shape, or pattern of components to provide the necessary support strength.

The subsurface 15' wide×19' long×4' deep concrete anchoring system 20 is reinforced with multiple layers of rebar, contains deadman, and provides the necessary strength, weight, and surface area to prevent overturn, slide, soil bearing failure, pullout and other failure from major vehicle impact event. A 4' long steel sleeve 22 may be installed in subsurface excavation at the location of each vertical steel tube member 16, with the concrete anchor system 20 poured around the sleeve. The concrete foundation may also include helical piers with rebar or other foundation anchoring systems, such as pilings or augers, to minimize the concrete foundation size or to overcome inferior soil conditions. In the illustrated embodiment of the barrier system, the three (3) vertical steel tubes 16 may be slid into the embedded steel sleeve 22, and pinned together in-place. With this design scenario, the top of the concrete surface is typically poured 12" below grade, so that when the vertical steel tubes are later removed, the concrete anchor system can be covered without noticeable signs of a previous barrier system. As an alternative, a hinge system may be incorporated to allow vertical steel to be tilted over after removing the pins. Alternative devices for mounting the barrier system or for concealing the concrete anchor system are included in the present invention.

The larger vertical 8"×12" steel tube 16 in front contains three (3) 4"×4" horizontal openings 30 where solid steel horizontal connection bars 3.5"×3.5"×12' long slide through. Each of these openings contain a 0.25" steel sleeve and 0.5" thick outside steel plate on the front and back of steel tube to reinforce opening in steel tube. These three (3) solid steel horizontal connection bars 32 slide in unison left and right to raise and lower the barrier net. High strength wheels 34 are attached to underside of steel bars to easily slide horizontal bars left and right; however, further embodiments of the invention may include wheels or other moving components at alternative locations. Referring again to FIG. 1, the rear side of the horizontal bar slides through the energy absorption unit 36, which is held in-place by a 1"×2" steel bar. The energy absorption unit may be positioned within the vertical steel tubes 16, as shown in FIG. 1, or external to the vertical steel tubes, such as between the vertical steel tubes 116 and the net system 112 as shown in FIG. 8. The horizontal bars 32 contain multiple 1" wide×2" deep side holes 1" apart to install or remove a steel pin 38, which engages or disengages the energy absorption unit 36, and allows the steel bars 32 to slide left and right, and raise or lower the barrier net 12. The steel pins 38 are 1"×2"×12" long with support angle to provide extra strength to pull the energy absorption spring into compression during vehicle impact event. The multiple side holes 40 allow adjustment so that net system 12 can be made "more" taut or "less" taut. The three (3) horizontal solid steel bars 32 are connected together at the back end to which winch 42 cable attach to pull back the three (3) solid steel bars in unison, which effectively raises and lowers the barrier net. FIG. 8 illustrates one embodiment of the barrier system with the barrier net in the raised position, and FIG. 9 illustrates the same embodiment of the barrier system with the barrier net in the lowered position. Alternative devices for raising and lowering the barrier net may be used.

Referring again to FIGS. 1–7, the front part of the solid steel horizontal bar 32 is connected to a 3.5" diameter high strength solid steel force equalization bar 44, using a removable steel connection 46. The connection 46 allows the vertical bar to pivot. This 3.5" diameter high strength solid steel force equalization bar 44 is preferably connected at three (3) equidistant locations to the horizontal solid steel bars 32 on one side and preferably connected at four (4) equidistant locations to the barrier net 12 using a removable steel connection 46 on the other side. The net steel connections 46 allow the net to pivot. The three (3) solid steel horizontal bars are effectively pulling on one side of the 3.5" diameter steel bar, and the four (4) barrier net connections are pulling on the other side, balancing out and distributing the forces across this bar and to all three (3) energy absorption units. Alternative devices for substantially equalizing the forces across the bar are also included in the present invention The net system 12 of the illustrated embodiment is made using spectrum fibers, which is a high strength and low weight fiber. The rope fibers are further enhanced by a recrystallization process which further strengthens the rope fibers. A non-limiting example of such rope fibers is available from Puget Sound Rope located in Anacortes, Wash. Horizontal rope members 50 are preferably 1" to 1.5" in diameter, and there are also preferably four (4) horizontal members equidistant at 15" on center. Vertical rope members 52 are preferably 0.5" to 1" in diameter, made of the same spectrum fiber and preferably spaced at 2' on center. The vertical rope members 52 are threaded through the horizontal members 50, and ties at the top and bottom horizontal ropes. This interlocking net system design and the spacing of its members and diameter of the ropes used are optimum in absorbing the impact forces, and allow the net system 12 to distribute the impact force almost equally across the net members, to the vertical force equalization bar 44 to the energy absorption units 36, and dissipate through the end supports 14. The net system 12 provides minimal stretch upon high impact. Furthermore, the net system will not creep or stretch when remaining in an "up" position, with constant tension load being applied, which would otherwise result in sagging. Further embodiments of the present invention may include alternative net materials or configurations (such as the number of horizontal ropes or the spacing of the vertical rope members) to achieve the requisite absorption properties and tension strength properties. In further embodiments of the barrier system, the ropes can be wrapped in a jacket for additional weather and UV protection. Additionally, a trough can be installed from one end support to another so that when the net system is lowered it lays into the trough so that the lowered net is below or level with the ground surface.

The energy absorption units 36 are unique in their ability to absorb about 120,000 lbs of force, and afterwards, resume their original shape. Energy absorbers 36 are large springs about 34" long, 10" in diameter with high strength steel about 1.625" in diameter, that are pulled into compression. There are six (6) energy absorption units 36 which preferably absorb 20,000 lbs of force each and provide about 24" of "cushion" or "give" upon initial impact (each energy absorption unit compresses about 12" for a total of about 24" from both sides). This is critical to stopping a 15,000 lb vehicle at impact speed of 50 mph or any vehicle impacting with approximately 350,000 lbs of force or more. The initial 120,000 lbs of impact force is absorbed, energy absorbers give 24" which allows for more than 10' of vehicle penetration. The net system 12 also stretches allowing for additional vehicle penetration. During the time that the energy absorbers give 24" and the net stretches, the vehicle decelerates significantly and kinetic energy is dissipated through the end supports and into the ground: After the net system reaches maximum stretch, the final impact force where the vehicle is jolted to a stop is far less because significant kinetic energy has been dissipated and the vehicle has decelerated. The vehicle is jolted back and rebounds. Further embodiments of the present invention may include any number of energy absorption units of alternative shapes and sizes and/or alternative force absorption as required by the specific application of the barrier system.

A battery powered winch system 42 preferably operates from two (2) 12 volt common batteries arranged in parallel. Advantageously, deep cycle marine batteries are used because of their ability to hold a charge longer. Controls allow use of only a first battery, a second battery, or both together, and preferably a volt meter continuously reads out remaining battery charge. A solar panel 54 designed specifically for recharging the 12 volt batteries is included in the illustrated embodiment of the barrier system 10 to constantly provide a trickle recharge to both batteries, thus the barrier system of the present invention is autonomously powered. The batteries can be recharged using simple jumper cables, similar to jumping an automobile. Alternatively or additionally, a 20-ton barge winch 56 is provided to manually raise or lower barrier net. The battery powered winch can raise and lower barrier net more than 20 times in a day without causing the system batteries to fully drain down power. The battery powered winch system can be operated with wireless signal, allowing one to raise and lower the barrier net remotely. Further embodiments of the present invention may provide alternative devices for raising and lowering the net system. Non-limiting examples may include pneumatic systems, jacking systems, or combinations thereof to raise the net.

The barrier system 10 of the illustrated embodiment also provides an alarm system to provide an alarm when the barrier system has been impacted by a vehicle. An infrared device 58 with controls is preferably installed on each of the 6"×6" vertical steel tubes at the end support. At the opposite end support, receiving devices are preferably placed on the 6"×6" vertical steel end supports to absorb the infrared light. Only when both infrared light beams are broken simultaneously, an alarm signal will be sent. On a temporary basis, the alarm can advantageously be turned off with key at end support. A vehicle impact event will break both light beams simultaneously, and trigger the alarm. This dual infrared light triggering and alarm requires minimal power (milliamps per day) and is also powered by the dual 12 volt batteries with solar power recharge. Further embodiments of the present invention may include alternative alarm systems. A non-limiting example of alternative alarm systems may include wires that are embedded or hung across the net system, which provides a signal alarm if broken or cut.

A roof system overhead protects components from snow, ice, and rain. Preferably, the roof system covers the top of the end supports; however, further embodiments of the present invention may substantially enclose the end supports.

The system components, steel supports, energy absorbers, and connections are all modular and meet size and weight limitations on military shipping containers, allowing systems to be packaged and shipped anywhere. Furthermore, the connections allow assembling and disassembling the barrier system without damage. Preferably, the vertical steel beams 16 are cut to length and have wheels 34 and horizontal holes 30 with sleeves in place. The vertical steel members 16 are first anchored into concrete foundation 20. The horizontal solid steel bars 32 are precut and include holes 40 for pins 38 that are slid in. Energy absorbers 36 are slid onto 1"×2" hooks already in place. The vertical force equalization bar 44 is connected to the solid steel bar using screwed pin shackle provided at three (3) locations. The four (4) net horizontal members 50 are connected to the vertical force equalization bar at four (4) locations using screwed pin shackles provided. The net system can be easily removed by disconnecting these screwed pin shackles. The net is accordingly stretched across secured area and connected to the other end support in similar manner. Further embodiments of the present invention may provide installation procedures having additional or alternative steps.

The winch, cables, steel, connections, batteries, and solar power recharge can be used in any environmental condition and as such is intended for "all weather" use. The systems were designed to be simple to use with minimal ongoing monthly maintenance and manpower requirements. Non-limiting examples of typical maintenance may include 1) checking the charge on the battery system, 2) ensuring the alarm system is active, and 3) providing moving components with lubricant.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A barrier system for stopping vehicles by dissipating an impact force generated when the vehicle impacts the barrier system, the barrier system comprising:

an anchoring system having at least one sleeve embedded therein, wherein the anchoring system defines a top surface and wherein the sleeve defines an internal dimension;

at least one end support defining at least one vertical support, wherein the vertical support may be selectively slid in and out of the sleeve of the anchoring system and wherein the vertical support defines an external dimension sized to be received by the internal dimension of the sleeve and defines a height from the top surface of the anchoring system to an uppermost portion of the vertical support opposite the anchoring system when the vertical support is selectively slid into the sleeve of the anchoring system;

at least one energy absorption unit supported by the vertical support, wherein the energy absorption unit is structured to dissipate substantially all of the impact force through the vertical support to the sleeve embedded in the anchoring system; and a net system connected to the energy absorption unit, wherein the net system is configured to selectively define a raised position and a lowered position;

wherein the vertical support extends vertically below the top surface of the anchoring system when the vertical support is selectively slid into the sleeve of the anchoring system and wherein the height of the vertical support when the net system is in the raised position is generally equivalent to the height of the vertical support when the net system is in the lowered position.

2. A barrier system according to claim 1, further comprising a force equalization bar that connects the net system to the energy absorption unit.

3. A barrier system according to claim 2 wherein the force equalization bar comprises at least one removable steel connection to connect the net system to the energy absorption unit.

4. A barrier system according to claim 1 wherein the anchoring system comprises pilings.

5. A barrier system according to claim 1 wherein the energy absorption unit is positioned between the vertical support and the net system.

6. A barrier system according to claim 1, further comprising an alarm system that provides an alarm signal in the event of a barrier system impact.

7. A barrier system according to claim 6 wherein the alarm system comprises an infrared device.

8. A barrier system according to claim 6 wherein the alarm system comprises at least one wire embedded in the net system that provides an alarm signal if the wire is broken.

9. A barrier system according to claim 1 wherein the energy absorption unit comprises a compression spring.

10. A barrier system according to claim 1 wherein the net system comprises spectrum fibers.

11. A barrier system according to claim 1, further comprising a winch system connected to the energy absorption unit for raising and lowering the net system.

12. A barrier system according to claim 11 wherein the winch system is powered by at least one battery.

13. A barrier system according to claim 12 wherein the battery is recharged by a solar panel.

14. A barrier system according to claim 11, further comprising a wireless signal device for remotely raising and lowering the net system.

* * * * *